US012287162B2

(12) United States Patent
Wang et al.

(10) Patent No.: US 12,287,162 B2
(45) Date of Patent: Apr. 29, 2025

(54) END COVER STRUCTURE AND WATER CHILLER

(71) Applicant: CHONGQING MIDEA GENERAL REFRIGERATION EQUIPMENT CO., LTD., Chongqing (CN)

(72) Inventors: Li Wang, Chongqing (CN); Hailong Lu, Chongqing (CN); Gaifang Chen, Chongqing (CN); Dengqing Zhou, Chongqing (CN)

(73) Assignee: CHONGQING MIDEA GENERAL REFRIGERATION EQUIPMENT CO., LTD., Chongqing (CN)

( * ) Notice: Subject to any disclaimer, the term of this patent is extended or adjusted under 35 U.S.C. 154(b) by 399 days.

(21) Appl. No.: 17/918,563

(22) PCT Filed: Dec. 11, 2020

(86) PCT No.: PCT/CN2020/135557
§ 371 (c)(1),
(2) Date: Oct. 13, 2022

(87) PCT Pub. No.: WO2021/253754
PCT Pub. Date: Dec. 23, 2021

(65) Prior Publication Data

US 2023/0138920 A1 May 4, 2023

(30) Foreign Application Priority Data

Jun. 17, 2020 (CN) ..... 202010554731.6

(51) Int. Cl.
*F28G 1/12* (2006.01)
*F25B 39/04* (2006.01)
(Continued)

(52) U.S. Cl.
CPC ..... *F28F 9/0246* (2013.01); *F25B 39/04* (2013.01); *F28F 27/02* (2013.01); *F28G 1/12* (2013.01); *F28D 2021/0061* (2013.01)

(58) Field of Classification Search
CPC ..... F28G 1/12; F28G 15/003
See application file for complete search history.

(56) References Cited

U.S. PATENT DOCUMENTS 4,688,630 A * 8/1987 Borchert ..... F28G 1/12 165/95
6,070,652 A 6/2000 Schildmann et al.
8,646,514 B2 * 2/2014 Ni ..... F28B 1/02 15/104.062

FOREIGN PATENT DOCUMENTS

CN 1766511 A 5/2006
CN 101329142 A 12/2008
(Continued)

OTHER PUBLICATIONS

First OA received in CN Application No. 202010554731.6; mailed Apr. 2, 2022.
(Continued)

*Primary Examiner* — Eric S Ruppert

(57) ABSTRACT

An end cover structure and a water chiller. The end cover structure includes: an end cover body; a water inlet pipe, provided on the end cover body; a water outlet pipe, provided on the end cover body, the water outlet pipe and the water inlet pipe being provided independent of each other; a bypass pipeline in which two cavities are formed, one of the two cavities being communicated with the water inlet pipe, and the other being communicated with the water outlet pipe; and an adjusting member, movably provided in the bypass pipeline. The adjusting member is movable to adjust the communication between the two cavities.

7 Claims, 2 Drawing Sheets

(51) Int. Cl.

| | |
|---|---|
| ***F28F 9/02*** | (2006.01) |
| ***F28F 27/02*** | (2006.01) |
| *F28D 21/00* | (2006.01) |

(56) References Cited

FOREIGN PATENT DOCUMENTS

| | | | |
|---|---|---|---|
| CN | 102095333 | A | 6/2011 |
| CN | 102944136 | A | 2/2013 |
| CN | 103256840 | A | 8/2013 |
| CN | 103278038 | A | 9/2013 |
| CN | 203349690 | U | 12/2013 |
| CN | 203908158 | U | 10/2014 |
| CN | 104880122 | A | 9/2015 |
| CN | 104896993 | A | 9/2015 |
| CN | 204815880 | U | 12/2015 |
| CN | 105277045 | A | 1/2016 |
| CN | 106568240 | A | 4/2017 |
| CN | 108534568 | A | 9/2018 |
| CN | 108759552 | A | 11/2018 |
| CN | 208805095 | U | 4/2019 |
| CN | 110440631 | A | 11/2019 |
| CN | 110470168 | A | 11/2019 |
| CN | 110470170 | A | 11/2019 |
| CN | 210533164 | U | 5/2020 |
| JP | 2020091067 | A | 6/2020 |
| KR | 20180060255 | * | 6/2018 |
| SU | 1409851 | A1 | 7/1988 |

OTHER PUBLICATIONS

First search received in CN Application No. 202010554731.6; mailed Mar. 29, 2022.

Supplementary search received in CN Application No. 202010554731.6; mailed Jun. 8, 2022.

Second OA received in CN Application No. 202010554731.6; mailed Jun. 14, 2022.

Extended European Search Report received in EP Application No. 20941063.8; mailed Sep. 12, 2023.

First OA received in Indian Application No. 202247051630; mailed Jan. 25, 2023.

International Search Report mailed Mar. 17, 2021 for PCT/CN2020/135557.

* cited by examiner

END COVER STRUCTURE AND WATER CHILLER

CROSS-REFERENCES TO RELATED APPLICATIONS

The present disclosure is a national phase application of International Application No. PCT/CN2020/135557, filed on Dec. 11, 2020, which claims priority to Chinese Patent Application No. 202010554731.6 filed with China National Intellectual Property Administration on Jun. 17, 2020, the entireties of which are herein incorporated by reference.

FIELD

The present disclosure relates to the field of heat exchange unit equipment, in particular, to an end cover structure and a water chiller.

BACKGROUND

Currently, due to the large heat exchange demand of office buildings, central air conditioners are often used as their air conditioning systems. However, in the initial period of use, since the temperature difference between the water inlet pipe and the water outlet pipe of a heat exchanger is small, the oil return of the water chiller in the central air conditioner will be reduced, and this greatly affects the normal use of the central air conditioners.

SUMMARY

The present disclosure aims to solve at least one of the problems in the prior art or related art.

Thus, one embodiment of the present disclosure is to provide an end cover structure.

Another embodiment of the present disclosure is to provide a water chiller.

One embodiment of the present disclosure provides an end cover structure, and it includes: an end cover body; a water inlet pipe, provided on the end cover body; a water outlet pipe, provided on the end cover body, the water outlet pipe and the water inlet pipe being provided independent of each other; a bypass pipeline in which two cavities are formed, one of the two cavities being communicated with the water inlet pipe, and the other being communicated with the water outlet pipe; and an adjusting member, movably provided in the bypass pipeline, and the adjusting member is movable to adjust the communication between the two cavities.

According to the embodiment of the second aspect of the present disclosure, a water chiller is provided, and it includes a unit shell, and a condenser is provided in the unit shell, and a heat exchange pipeline is arranged on the condenser; and the end cover structure in any one of the embodiments of the first aspect, disposed at one end of the unit shell, and a water inlet pipe and a water outlet pipe of the end cover structure are respectively connected with the inlet and the outlet of the heat exchange pipeline.

The embodiments of the present disclosure will be shown in the following description, or can be understood through the embodiments of the present disclosure.

In one embodiment, the corresponding relations among the reference signs in FIG. 1 to FIG. 4 and the names of the components are as follows:

12 end cover body; 14 water inlet pipe; 142 first differential pressure joint; 16 water outlet pipe; 162 second differential pressure joint; 18 bypass pipeline; 20 adjusting member; 22 controller; 24 pressure sensor; 30 flushing member; 32 blocking member; 34 unit shell.

DETAILED DESCRIPTION OF THE DISCLOSURE

In order that the above-mentioned embodiments of the present disclosure can be understood more clearly, a further detailed description of the present disclosure will be given below in connection with the accompanying drawings and exemplary embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can further be implemented in other manners than those described herein. Therefore, the protection scope of the present disclosure is not limited to the exemplary embodiments disclosed below.

Referring to FIG. 1 to FIG. 4, some embodiments of the present disclosure are described in the following.

Figure 1:
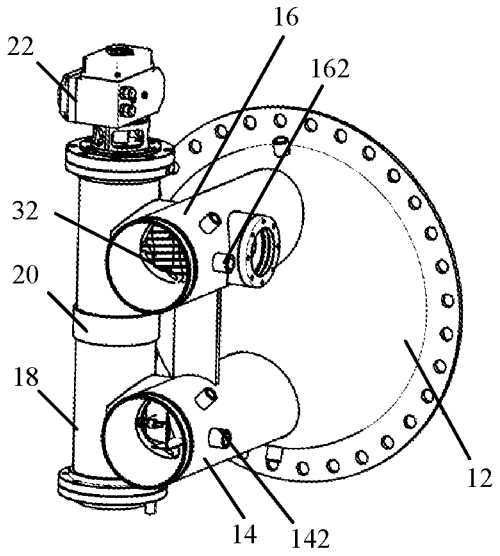
FIG. 1 is a schematic view of the structure of an end cover structure according to an embodiment of the present disclosure.

As shown in FIG. 1, according to an embodiment of the present disclosure, an end cover structure is provided, and it includes: an end cover body 12 on which a water inlet pipe 14 and a water outlet pipe 16 are provided; and a bypass pipeline 18 which connects the water inlet pipe 14 and the water outlet pipe 16, and the bypass pipeline 18 is provided with two cavities divided by an adjusting member 20, and one of the two cavities is communicated with the water inlet pipe 14, and the other is communicated with the water outlet pipe 16; and the adjusting member 20 is movably provided in the bypass pipeline 18 to conduct or disconnect the two cavities.

In one embodiment, the water inlet pipe 14 is disposed below the water outlet pipe 16.

In an embodiment, when the adjusting member 20 moves to a position where the two cavities are communicated with each other, the fluid in the water inlet pipe 14 can be directly communicated with the water outlet pipe 16 through the bypass pipeline 18, to adjust the pressure difference between the water inlet pipe and the water outlet pipe 16.

In another embodiment, when the adjusting member 20 moves to a position where the two cavities are disconnected, the fluid enters a heat exchange pipeline through the water inlet pipe 14 and flows out through the water outlet pipe 16. Then, washing operation can be conducted to the water inlet pipe 14, the heat exchange pipeline and the water outlet pipe 16, to maintain a normal heat exchange operation of the pipeline.

Figure 2:
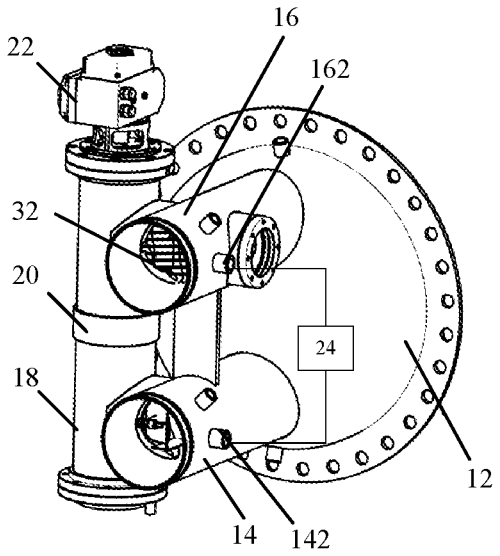
FIG. 2 is a schematic view of the structure of an end cover structure according to an embodiment of the present disclosure.

Based on the embodiment 1, as shown in FIG. 2, in order to improve the mobile intelligence of the adjusting member 20, a controller 22 and a pressure sensor 24 are provided, and the controller 22 is provided at an end of the bypass pipeline 18, and is in transmission connection with the adjusting member 20; the pressure sensor 24 is in electrical connection with the controller 22 and configured to detect the pressure in the water inlet pipe 14 and the water outlet pipe 16. It can be understood that when there is not any fluid flowing in the water inlet pipe 14 or in the water outlet pipe 16, the pressure is the atmospheric pressure; when there is fluid flowing in the water inlet pipe 14 and in the water outlet pipe 16, the pressure is the water pressure in the pipe.

Figure 3:
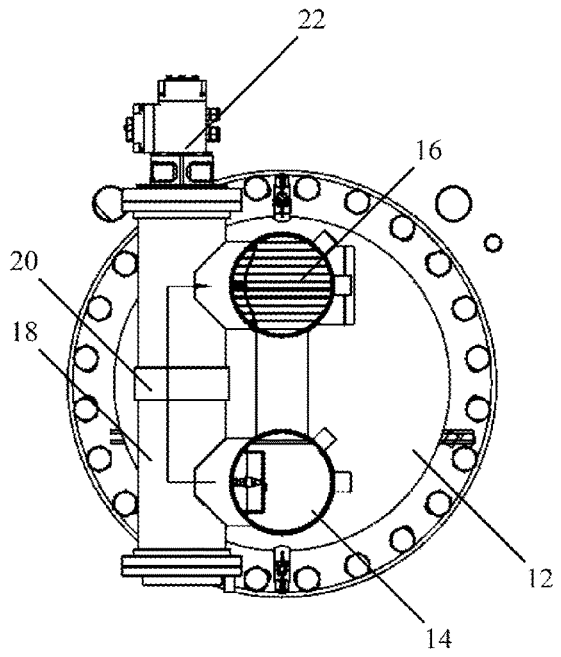
FIG. 3 is a schematic view of the structure of an end cover structure according to an embodiment of the present disclosure.

When the pressure difference is less than a pressure difference threshold, the adjusting member 20 is controlled to be opened and the bypass pipeline 18 is conducted, and then, as shown in FIG. 3, the direction of the arrow is the flow direction of the water flow, and the opening range of the adjusting member 20 can be controlled by the controller 22, that is, the opening degree of the bypass pipeline 18 can be adjusted.

When the pressure difference is greater than or equal to the pressure difference threshold, the adjusting member 20 is controlled to be closed and the bypass pipeline 18 is disconnected.

The pressure sensor 24 detects the pressure of the water inlet pipe 14 and the water outlet pipe 16 mainly through a first differential pressure joint 142, a second differential pressure joint 162 and two pressure interfaces. For example, the pressure of the water inlet pipe 14 can be transmitted to the pressure sensor 24 through the first differential pressure joint 142 and a corresponding pressure interface. Similarly, the pressure of the water outlet pipe 16 can be transmitted to the pressure sensor 24 through the second differential pressure joint 162 and a corresponding pressure interface, and the pressure sensor 24 can determine the pressure difference by comparing the two pressure values.

According to an embodiment of the present disclosure, an end cover structure is provided, and it includes: an end cover body 12 on which a water inlet pipe 14 and a water outlet pipe 16 are provided; and a bypass pipeline 18 which connects the water inlet pipe 14 and the water outlet pipe 16, and the bypass pipeline 18 is provided with two cavities divided by an adjusting member 20, and one of the two cavities is communicated with the water inlet pipe 14, and the other is communicated with the water outlet pipe 16; and the adjusting member 20 is movably provided in the bypass pipeline 18 to conduct or disconnect the two cavities.

In addition, when the pressure difference between the water inlet pipe 14 and the water outlet pipe 16 is relatively large, for example, the pressure difference is greater than or equal to a pressure difference threshold, a spherical flushing member 30 can be placed in the water inlet pipe 14, and a mesh blocking member 32 can be embedded in the water outlet pipe 16.

In one embodiment, it can be understood that the more the flushing members 30 are placed into the water inlet pipe 14, the better the cleaning effect to the pipeline connected to the end cover structure is.

Figure 4:
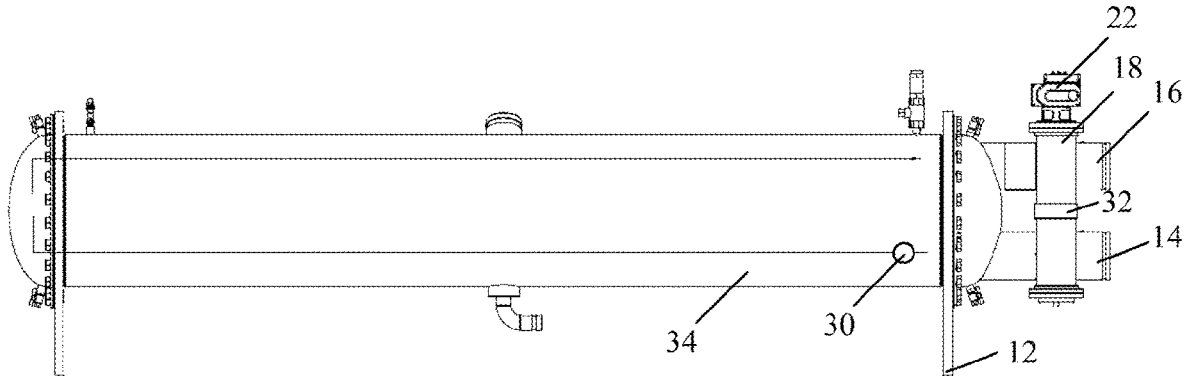
FIG. 4 is a schematic view of the structure of a water chiller according to an embodiment of the present disclosure.

As shown in FIG. 4, an embodiment of the present disclosure provides a water chiller, which includes a unit shell 34 and the end cover structure in any one of the above embodiments, and the end cover structure is disposed at one end of the unit shell 34; a condenser and a heat exchange pipeline are arranged in the unit shell 34, and a water inlet pipe 14 and a water outlet pipe 16 of the end cover structure are respectively connected with the inlet and the outlet of the heat exchange pipeline, and the fluid can flow into the heat exchange pipeline through the water inlet pipe 14 and the inlet, and flows out of the outlet to the water outlet pipe 16.

After water is injected into the heat exchange pipeline, at the initial stage of start-up operation, if the pressure difference is determined to be less than a pressure difference threshold through the pressure sensor 24 of the end cover structure, the adjusting member 20 is controlled by the controller 22 to open the bypass pipeline 18, and the fluid in the water inlet pipe 14 directly flows to the water outlet pipe 16 without passing through the whole heat exchange pipeline, until the pressure difference reaches the pressure difference threshold, that is, the pressure difference is greater than or equal to the pressure difference threshold, and then the adjusting member 20 is closed through the controller 22 to disconnect the two cavities of the bypass pipeline 18. Then, as shown by the direction of the arrow in FIG. 4, the fluid in the water inlet pipe 14 will first pass through the heat exchange pipeline via the inlet, and then flow out through the water outlet pipe 16 via the outlet.

On the basis that the fluid flows through the heat exchange pipeline, if the inner wall of the pipeline needs to be cleaned, one or more spherical flushing members 30 can be placed in the water inlet pipe 14 according to the amount of dirt, and the moving path of the flushing members 30 is the same with the flowing direction of water.

It can be understood that if there is relatively a large amount of dirt on the inner wall of the pipeline, the inner wall of the pipeline can be washed by labor first, after the large piece of dirt is removed, the flushing member 30 is placed in the water inlet pipe 14.

According to an exemplary embodiment of the present disclosure, an end cover structure and a water chiller are provided, and the end cover structure can be used as a bypass valve at the initial start-up stage of the water chiller to effectively bypass cooling water; when the unit is running stably, it can be used as a rubber ball cleaning device to reduce costs, save space, increase heat exchange performance, and improve the reliability of the unit.

For example, at the beginning of start-up, a water chiller control system detects and calculates that the pressure difference is less than a set value, and an electric actuator (i.e., a controller 22) rotates to a specified position, a central partition plate (i.e., an adjusting member 20) of a cleaning device (i.e., the end cover structure) is opened to form an effective channel, and the cooling water in the inlet of the condenser is directly bypassed to the outlet, the bypass amount is automatically calculated according to the unit control system, and the opening degrees of the inlet and the outlet are controlled by the rotation of the actuator, to control the bypass amount of the cooling water.

When the entire system is stable, the pressure difference should be greater than or equal to a set value, the control system logically switches to an automatic cleaning state, the actuator rotates to a corresponding position, and small silicone balls of the cleaning device are started from the inlet of the cooling water inlet, pass through the heat exchange copper tube, return to the outlet of the cooling water outlet, then pass through a baffle net, and return to the cylinder of the cleaning device, to complete a cleaning cycle; and FIG. 4 shows the trajectory of the small silicone balls. When the control system detects and calculates that the pressure difference is less than the set value at the inlet position of the cooling water, the electric actuator rotates to the specified position, and the central partition plate in the cleaning device is opened to perform bypass processing again.

Through the above embodiments, the cleaning device can operate continuously, the fouling coefficient of the condenser can be reduced, the heat exchange effect of the whole machine can be improved, and the objects of saving energy, reducing consumption, avoiding reporting high-pressure failure and improving the operation stability of the unit are achieved. In addition, no additional power source is required for receiving or emitting the small silicone balls, and thus additional energy consumption is reduced. In terms of space, the bypass function is added to the cleaning device and the cleaning device is integrated into the condenser, and this reduces occupied area.

Through the end cover structure and the water chiller provided by the present disclosure, by setting the bypass pipeline and the adjusting member, both the bypass function and the cleaning function can be realized.

In the present disclosure, the terms of "first", "second" and "third" are used only for the purpose of description and shall not be understood to indicate or imply any relative importance; the term of "multiple" refers to two or more, unless otherwise clearly defined. The terms of "mounting", "connected to", "connected with", "fix" and the like should be understood in a broad sense, for example, the term "connect with" can be a fixed connection, a detachable connection, or an integral connection; the term "connected to" can be a direct connection or an indirect connection through an intermediate medium. The specific meanings of the above-mentioned terms in the present disclosure according to specific circumstances.

In the description of the present disclosure, it needs to be understood that the orientation or position relations indicated by the terms "upper", "lower", "left", "right", "front", "rear" and the like are based on the orientation or position relations shown in the accompanying drawings, and they are just intended to conveniently describe the present disclosure and simplify the description, and are not intended to indicate or imply that the devices or units as indicated should have specific orientations or should be configured or operated in specific orientations, and then should not be construed as limitations to the present disclosure.

In the specification of the present disclosure, the terms of "an embodiment", "some embodiments", "exemplary embodiment" and the like mean that the specific features, structures, materials or characteristics described in combination with the embodiment or example are included in at least one embodiment or example of the present disclosure. In the specification, the illustrative expression of the above terms may not indicate the same embodiment or example. In addition, the specific features, structures, materials or characteristics described above may be combined in an appropriate method in one or more of any embodiments or examples.

What is claimed is:

1. An end cover structure comprising:

an end cover body;

a water inlet pipe, provided on the end cover body;

a water outlet pipe, provided on the end cover body, and the water outlet pipe and the water inlet pipe being provided independent of each other;

a bypass pipeline in which two cavities are formed, a first of the two cavities being communicated with the water inlet pipe, and a second of the two cavities being communicated with the water outlet pipe;

an adjusting member, movably provided in the bypass pipeline, wherein, the adjusting member is movable to adjust communication between the two cavities;

a controller, wherein the controller is provided at an end of the bypass pipeline, and is in transmission connection with the adjusting member; and the controller can control the adjusting member to move and then to adjust a circulation volume of fluid flowing between the two cavities; and a pressure sensor, in electrical connection with the controller, wherein the pressure sensor is configured to detect pressure difference in the water inlet pipe and the water outlet pipe; when the pressure difference is less than a pressure difference threshold, the controller controls movement of the adjusting member to adjust the circulation volume.

2. The end cover structure according to claim 1, further comprising:

a first differential pressure joint provided on the water inlet pipe; and a second differential pressure joint provided on the water outlet pipe;

wherein the pressure sensor is provided with two pressure interfaces respectively connected with the first differential pressure joint and the second differential pressure joint, to detect the pressure difference in the water inlet pipe and the water outlet pipe.

3. The end cover structure according to claim 1, wherein when pressure difference in the water inlet pipe and the water outlet pipe is not less than a pressure difference threshold, the controller is further used to control the adjusting member to move to disconnect the communication between the two cavities in the bypass pipeline.

4. The end cover structure according to claim 1, wherein a flushing member which can flow in the water inlet pipe and the water outlet pipe; and a blocking member, provided in the water outlet pipe, wherein the flushing member can move to and contact the blocking member to stop flowing.

5. The end cover structure according to claim 4, wherein the flushing member is in a spherical shape, while the blocking member is in a meshed shape; the diameter of the flushing member is not greater than the minimum inner diameter of the water inlet pipe, and the diameter of the flushing member is not greater than the minimum inner diameter of the water outlet pipe.

6. The end cover structure according to claim 4, wherein when the pressure difference between the water inlet pipe and the water outlet pipe is not less than the pressure difference threshold, the flushing member is in the water inlet pipe, and under an effect of the fluid, the flushing member flows from the water inlet pipe to the water outlet pipe.

7. The end cover structure according to claim 1, wherein the water inlet pipe is disposed below the water outlet pipe.

* * * * *